US005828811A

United States Patent [19]

Taniguchi et al.

[11] Patent Number: 5,828,811

[45] Date of Patent: Oct. 27, 1998

[54] SPEECH SIGNAL CODING SYSTEM WHEREIN NON-PERIODIC COMPONENT FEEDBACK TO PERIODIC EXCITATION SIGNAL SOURCE IS ADAPTIVELY REDUCED

[75] Inventors: Tomohiko Taniguchi; Yasuji Ohta; Yoshinori Tanaka; Hideaki Kurihara; Yoshihiro Sakai, all of Kawasaki, Japan

[73] Assignee: Fujitsu, Limited, Kawasaki, Japan

[21] Appl. No.: 188,124

[22] Filed: Jan. 28, 1994

Related U.S. Application Data

[63] Continuation of Ser. No. 838,339, Feb. 20, 1992, abandoned.

[30] Foreign Application Priority Data

Feb. 20, 1991 [JP] Japan ..... 3-026085

[51] Int. Cl.[6] ..... G10L 9/14

[52] U.S. Cl. ..... 395/2.29; 395/2.32

[58] Field of Search ..... 381/29–40; 395/2.28–2.32, 395/2.16, 2.17, 2.23

[56] References Cited

U.S. PATENT DOCUMENTS

| | | | |
|---|---|---|---|
| 4,791,670 | 12/1988 | Copperi et al. | 395/2.31 |
| 4,899,385 | 2/1990 | Ketchum et al. | 381/36 |
| 4,933,957 | 6/1990 | Bottau et al. | 395/2.28 |
| 5,060,269 | 10/1991 | Zinser | 381/38 |
| 5,293,449 | 3/1994 | Tzeng | 395/2.32 |
| 5,295,224 | 3/1994 | Makamura et al. | 395/2.29 |
| 5,307,460 | 4/1994 | Garten | 395/2.28 |
| 5,481,642 | 1/1996 | Shoham | 395/2.28 |

FOREIGN PATENT DOCUMENTS

0415675 A3 6/1991 European Pat. Off. ..... G10L 9/14

OTHER PUBLICATIONS

Taniguchi et al.,Pitch sharpening for perceptually improved CELP and the sparse–delta codebook for reduced computation, *International Conference on Acoustics Speech and Signal Processing*, pp. 241–244, May 1991.

Taniguchi et al., "principal axis extracting vector excitation coding: high quality speech at 8 KB/S", *International Conference on Acoustics Speech and Signal Processing*, pp. 241–244, Apr., 1990.

Kroon et al., strategies for improving the performance of CELP coders at low bit rates, *International Conference on Acoustics Speech and Signal Processing*, pp. 151–154, Apr., 1988.

(List continued on next page.)

*Primary Examiner*—David D. Knepper
*Attorney, Agent, or Firm*—Staas & Halsey

[57] ABSTRACT

Speech coding uses a periodic excitation signal source, a non-periodic signal excitation source, a synthesizing unit, a filter, and an error evaluating unit. The synthesizing unit synthesizes a periodic excitation signal and a non-periodic excitation signal output from the above-mentioned sources to generate an excitation sound source signal. The filter regenerates an input speech signal from the excitation sound signal. The error evaluating unit controls the periodic excitation signal source and the non-periodic excitation signal source so that the above-mentioned units output periodic and non-periodic excitation signals which minimize a difference of the regenerated signal from an input speech signal. When the error is minimized, the above-mentioned sound source is supplied to a feedback excitation signal modifying unit. The feedback excitation modifying unit reduces a non-periodic component in the above-mentioned supplied signal so that the non-periodic component is reduced more when the relative amount of the periodic component is greater. The modified signal is fed back to the periodic excitation signal source unit to modify the content thereof.

10 Claims, 6 Drawing Sheets

OTHER PUBLICATIONS

Jayant, et al., "Speech coding with time–varying bit allocations to excitation and LPC parameters", *International Conference on Acoustics Speech and Signal Processing*, pp. 65–68, May, 1989.

M.R. Schroeder and B.S. Atal, "Code–Excited Linear Prediction (CELP): High–Quality Speech at Very Low Bit Rates", Proc. IEEE–ICASSP, Apr. 1985, pp. 937–940.

N.S. Jayant and J.H. Chen, "Speech Coding with Time–Varying Bit Allocations to Excitation and LPC Parameters", Proc. IEEE–ICASSP, May 1989, pp. 65–68.

Y. Shoham, "Constrained–Stochastic Excitation Coding of Speech at 4.8 KB/S", Proc. ICSLP 90, Nov. 1990, pp. 645–648.

I.A. Gerson and M.A. Jasiuk, "Vector Sum Excited Linear Prediction (VSELP) Speech Coding at 8 KBPS", Proc. ICASSP 90, Apr. 1990, pp. 461–464.

P. Kroon and B.S. Atal, "Predictive Coding of Speech Using Analysis–by–Synthesis Techniques", *Advances in Speech Signal Processing*, edited by S. Furui and M.M. Sondhi, Marcel Dekker, Inc., New York 1992, pp. 141–164.

Parson's, Thomas, *Voice and Speech Processing*, 1987, McGraw—Hill, pp. 159–161.

SPEECH SIGNAL CODING SYSTEM WHEREIN NON-PERIODIC COMPONENT FEEDBACK TO PERIODIC EXCITATION SIGNAL SOURCE IS ADAPTIVELY REDUCED

This application is a continuation of application Ser. No. 07/838,339, filed Feb. 20, 1992, now abandoned.

BACKGROUND OF THE INVENTION (1) Field of the Invention

The present invention relates to a speech signal coding apparatus for encoding a speech signal to compress and transmit speech data, and a speech signal decoding apparatus for decoding the coded speech data to regenerate the speech signal.

(2) Description of the Related Art

Recently, speech signal coding systems wherein speech signals are compressed with high efficiency, are required in communication systems and speech signal recording systems, and some techniques are proposed for realizing such a speech signal coding system. Among those proposed systems, in particular, the Code-Excited Linear Prediction Coding (CELP) System is known as a speech signal coding system wherein a speech signal can be compressed with high efficiency and quality of the speech signal is maintained. The CELP system is disclosed, for example, by M. R. Schroeder et al., "Code-Excited Linear Prediction (CELP) High-Quality Speech at Very Low Bit Rates" Proceedings of IEEE International Conference on Acoustics, Speech, and Signal Processing, pp. 937–940, Apr. 1988, N. S. Jayant et al., "Speech Coding with Time-Varying Bit Allocations to Excitation and LPC Parameters", pp. 65–68, May 1989, and I. A. Gerson et al., "Vector Sum Excited Linear Prediction (VSELP) Speech Coding at 8 kbps", pp. 461–464, April 1990.

In a typical CELP system, a speech signal coding apparatus comprises an adaptive codebook (sound source) outputting a pitch vector having a pitch-periodic characteristic, a stochastic codebook (sound source) outputting a code vector having a non-periodic (random) characteristic, an adder synthesizing the pitch vector and the code vector to generate an excitation sound source signal, and a short-term prediction synthesis filter carrying out short-term predictions such as a linear prediction to regenerate a signal simulating an input speech signal. A difference between the regenerated signal and an input speech signal signal, is obtained as an error. Then, the error signal is perceptually weighted by a perceptual weighting filter, and the perceptually weighted error is evaluated by an error evaluating unit to select an optimum pitch vector in the adaptive codebook and an optimum code vector in the stochastic codebook, to be output therefrom, respectively. The above excitation sound source signal is fed back to the adaptive codebook to make the output of the adaptive codebook adaptively follow the time-varying characteristic of the input speech signal.

Since the adaptive codebook is provided for outputting a periodic excitation signal, it is desirable to feedback only a periodic component to the adaptive codebook. However, if only a periodic component is fed back to the adaptive codebook, the content of the adaptive codebook cannot be renewed, and therefore the output of the adaptive codebook cannot follow the characteristic of the input speech signal. In particular, since the content of the adaptive codebook is zero in an initial state, the adaptive codebook cannot output a non-zero output signal without supplying a non-periodic component thereto. Therefore, conventionally, the above excitation sound source signal, which is output from the adder synthesizing the outputs of the adaptive codebook and the stochastic codebook, contains a periodic component and a non-periodic component, and there is a drawback that the above supply of the non-periodic component to the adaptive codebook causes degradation in a regenerated speech signal when regenerating an input speech signal having a strong pitch-periodic characteristic.

SUMMARY OF THE INVENTION

An object of the present invention is to provide a speech signal coding apparatus comprising an adaptive codebook and a stochastic codebook used for generating an excitation sound source signal, wherein the quality of regenerated speech signal is improved when regenerating an input speech signal having a strong pitch-periodic characteristic.

Another object of the present invention is to provide a speech signal decoding apparatus comprising an adaptive codebook and a stochastic codebook used for generating an excitation sound source signal, wherein the quality of a regenerated speech signal is improved when regenerating an input speech signal having a strong pitch-periodic characteristic.

According to the first aspect of the present invention, there is provided a speech signal coding apparatus inputting an input speech signal, and coding the input speech signal, comprising: a periodic excitation signal source unit holding a set of a plurality of periodic excitation signals, for outputting one of the plurality of periodic excitation signals in response to a first control signal, where the above set is adaptively modified according to a feedback signal thereto; a non-periodic excitation signal source unit holding a set of a plurality of non-periodic excitation signals, for outputting one of the above plurality of non-periodic excitation signals in response to a second control signal; a synthesizing unit for inputting and synthesizing the above periodic excitation signal output from the periodic excitation signal source unit and the above non-periodic excitation signal output from the non-periodic excitation signal source unit, to generate an excitation sound source signal; a short-term prediction filter unit for inputting the excitation sound source signal, and generating a regenerated signal which simulates the above input speech signal, based on excitation sound source signals recently input thereto preceding the above excitation sound source signal, by short-term prediction; an error obtaining unit for obtaining a difference between the above input speech signal and the above regenerated signal as an error signal; an error evaluating unit for scanning the above first and second control signals while monitoring the error signal, to adjust the first and second control signals so that a power of the error signal is minimized to optimize the excitation sound source signal; and a feedback signal modifying unit for inputting the above optimized excitation sound source signal, modifying the optimized excitation sound source signal by reducing a non-periodic component in the optimized excitation sound source signal according to a relative amount of the non-periodic component in the optimized excitation sound source signal so that the non-periodic component is reduced more when the relative amount of the periodic component is greater, and supplying the modified optimized excitation sound source signal to the above periodic excitation signal source unit as the above feedback signal.

According to the second aspect of the present invention, there is provided a speech signal decoding apparatus for inputting and decoding code information to regenerate a speech signal, comprising: a periodic excitation signal source unit holding a set of a plurality of periodic excitation signals, for outputting one of the plurality of periodic excitation signals in response to the above first control signal, where the above set is adaptively modified according to a feedback signal thereto; a non-periodic excitation signal source unit holding a set of a plurality of non-periodic excitation signals, for outputting one of the plurality of non-periodic excitation signals in response to the above second control signal; a synthesizing unit for inputting and synthesizing the above periodic excitation output from the periodic excitation signal source unit and the above non-periodic excitation signal output from the non-periodic excitation signal source unit, to generate an excitation sound source signal; a short-term prediction filter unit for inputting the excitation sound source signal, and generating a regenerated signal which simulates the above input speech signal, based on excitation sound source signals recently input thereto preceding the above excitation sound source signal, by short-term prediction; and a feedback signal modifying unit for inputting the excitation sound source signal, modifying the excitation sound source signal by reducing a non-periodic component in the excitation sound source signal according to a relative amount of the non-periodic component in the excitation sound source signal so that the non-periodic component is reduced more when the relative amount of the periodic component is greater, and supplying the modified excitation sound source signal to the above periodic excitation signal source unit as the above feedback signal.

DESCRIPTION OF THE PREFERRED EMBODIMENTS

Figure 1:
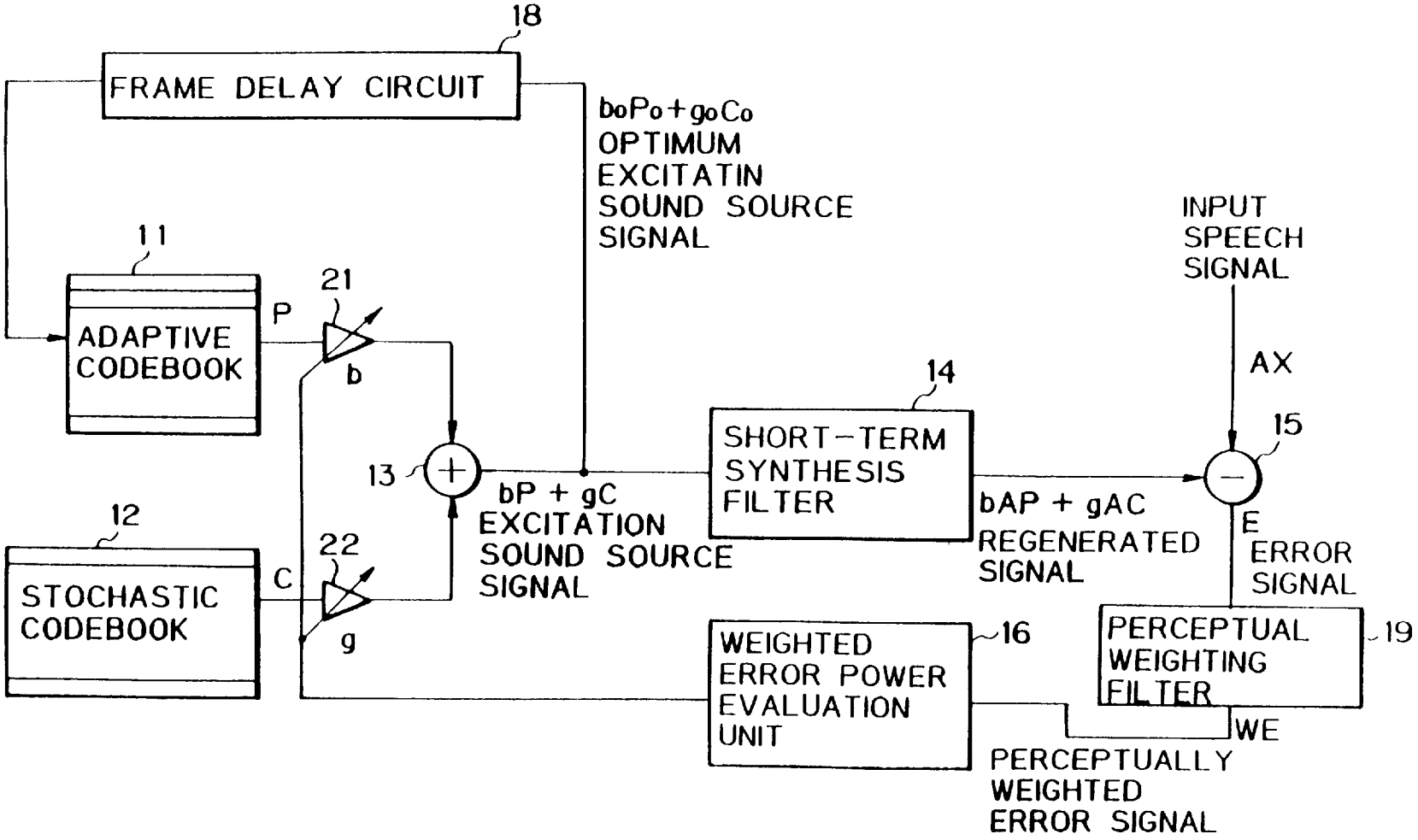
Fig. 1 PRIOR ART
FIG. 1 is a diagram illustrating the construction of a conventional speech coding apparatus.
Figure 2:
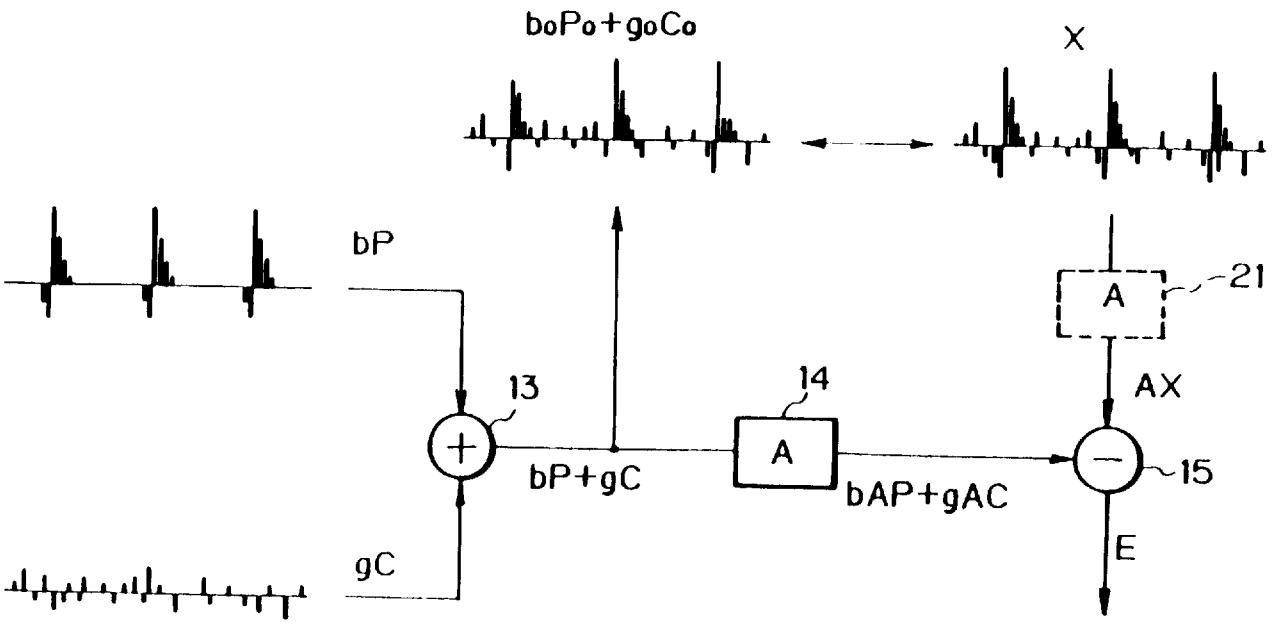
Fig. 2 PRIOR ART
FIG. 2 is a diagram illustrating the operations of the construction of FIG. 1.

Conventional Speech Coding Apparatus (FIGS. 1 and 2)

Figure 3:
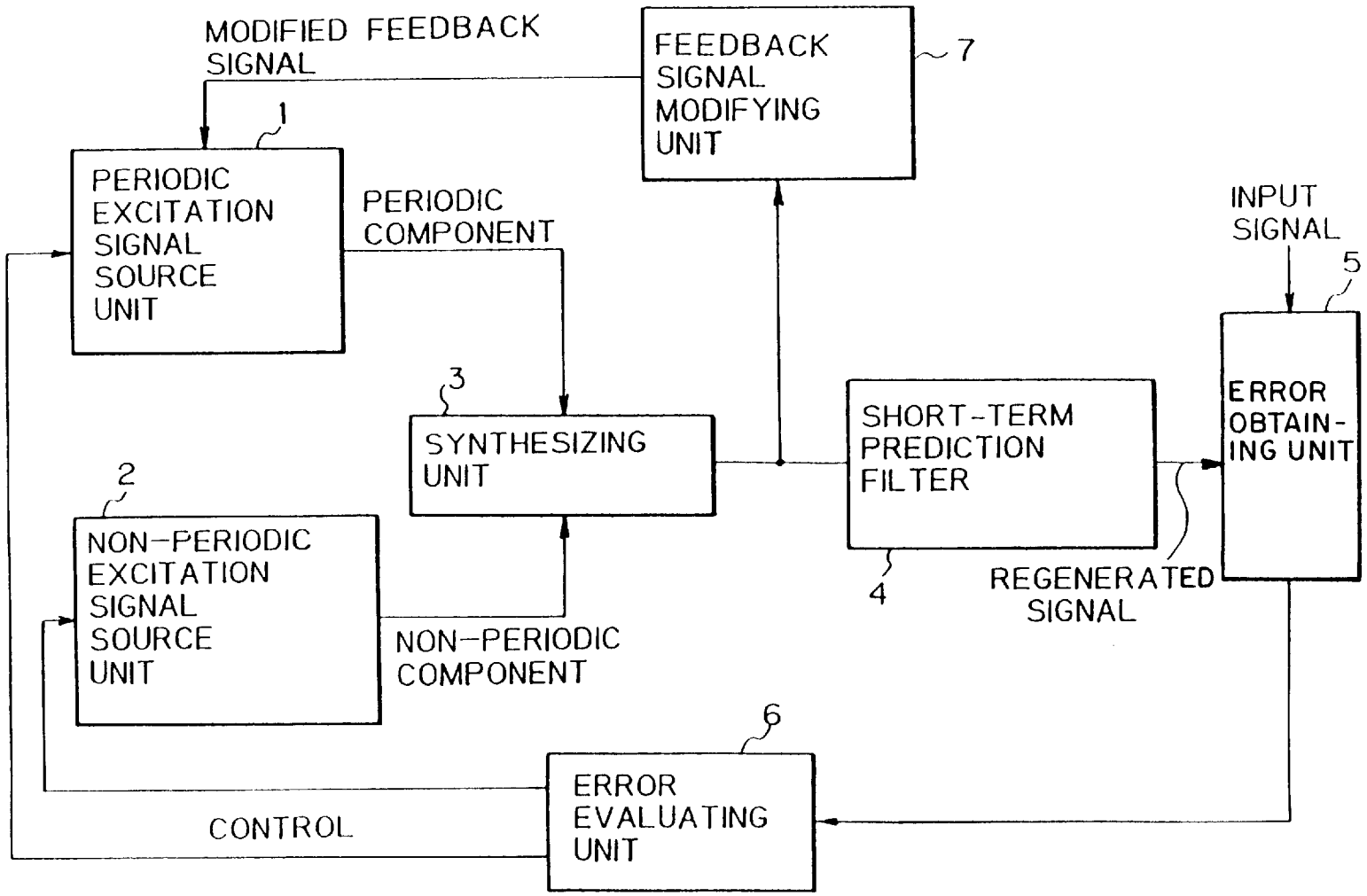
FIG. 3 is a diagram illustrating the basic construction of the speech coding apparatus according to the first aspect of the present invention.

FIG. 1 is a diagram illustrating the construction of a conventional speech coding apparatus. In FIG. 3, reference numeral 11 denotes an adaptive codebook (sound source) outputting a pitch vector P having a pitch-periodic characteristic; 12 denotes a stochastic codebook (sound source) outputting a code vector C having a non-periodic (random) characteristic; 21 denotes an amplifier for amplifying the periodic excitation signal P output from the adaptive codebook 11 with a gain b; 22 denotes an amplifier for amplifying the non-periodic excitation signal C output from the stochastic codebook 12 with a gain g; 13 denotes an adder synthesizing the above amplified pitch vector bP and the above amplified code vector gC to generate an excitation sound source signal bP+gC; 14 denotes a short-term prediction synthesis filter carrying out short-term prediction such as a linear prediction to regenerate a signal bAP+gAC simulating an input speech signal X; 15 denotes a subtracter for obtaining a difference E between an input speech signal AX and the regenerated signal output bAP+gAC from the short-term prediction synthesis filter 14 as an error signal, 16 denotes a weighted error power evaluating unit for selecting a pitch vector P in the adaptive codebook 11 and a code vector C in the stochastic codebook 12, to be output therefrom, respectively, and adjusting the above gains b and g, so that a power of the weighted error signal E is minimized; 18 denotes a frame delay circuit through which the above excitation sound source signal output from the adder 13 is supplied to the adaptive codebook 11; and 19 denotes a perceptual weighting filter for perceptual weighting the error signal E to generate a perceptually weighted error signal WE.

The characteristic of the above short-term prediction synthesis filter 14 is expressed as $$A(z) = 1/\left(1 - \sum_{i=1}^{p} ai \cdot z^{-i}\right) \tag{1}$$

where ai's (i=1−p) are and prediction coefficients, and the characteristic of the perceptual weighting filter 19 is expressed as $$W(z) = \left(1 - \sum_{i=1}^{p} ai \cdot z^{-i}\right) / \left(1 - \sum_{i=1}^{p} ai \cdot \lambda^{i} z^{-i}\right), \tag{2}$$

where $\lambda$ ($0.0 \leqq \lambda \leqq 1.0$) is a coefficient defining the characteristic of the perceptual weighting filter 19.

The output of the adder 13 is optimized by minimizing the power of the weighted error signal output from the perceptual weighting filter 19, and the optimized excitation sound source signal boPo+goCo containing the non-periodic component goCo is supplied through the frame delay circuit 18 to the adaptive codebook 11 to modify the content of the adaptive codebook 11. Typical waveforms of the signals in the construction of FIG. 1 are indicated in FIG. 2. In FIG. 2, 21 denotes a human filter by an aural cavity through which the above speech signal AX is generated from an excitation sound signal X generated by a vocal cord. As explained above, the above supply of the non-periodic component goco to the adaptive codebook 11 causes degradation in a regenerated speech signal when regenerating an input speech signal having a strong pitch-periodic characteristic.

Basic Operations of the Present Invention (FIG. 3)

FIG. 3 is a diagram showing the basic construction of the speech signal coding apparatus according to the first aspect of the present invention. In FIG. 3, reference numeral 1 denotes a periodic excitation signal source unit, 2 denotes a non-periodic excitation signal source unit, 3 denotes a synthesizing unit, 4 denotes a short-term prediction filter unit, 5 denotes an error obtaining unit, 6 denotes an error evaluating unit, and 7 denotes a feedback signal modifying unit.

In the construction of FIG. 3, the periodic excitation signal source unit 1 holds a set of a plurality of periodic excitation signals, and outputs one of the plurality of periodic excitation signals in response to a first control signal, which is supplied thereto from the error evaluating unit 6 as explained below. In addition, the content of the periodic excitation signal source unit 1, i.e., the above set is adaptively modified according to a feedback signal supplied thereto from the synthesizing unit 3. The non-periodic excitation signal source unit 2 holds a set of a plurality of non-periodic excitation signals, and outputs one of the above plurality of non-periodic excitation signals in response to a second control signal, which is also supplied thereto from the error evaluating unit 6 as explained below. The synthesizing unit 3 inputs and synthesizes the above periodic excitation signal output from the periodic excitation signal source unit 1 and the above non-periodic excitation signal output from the non-periodic excitation signal source unit 2, to generate an excitation sound source signal, which is optimized by minimizing a power of the error obtained by the error obtaining unit 5 as explained below. The short-term prediction filter unit 4 inputs the excitation sound source signal, and generates a regenerated signal which simulates the above input speech signal, based on excitation sound source signals recently input thereto preceding the above excitation sound source signal, by short-term prediction. The error obtaining unit 5 obtains a difference between the above input speech signal and the above regenerated signal as an error signal, and the error evaluating unit 6 scans the above first and second control signals while monitoring the error signal, to adjust the first and second control signals so that a power of the error signal is minimized and thereby optimizing said excitation sound source signal. According to the present invention, the feedback signal modifying unit 7 inputs the above optimized excitation sound source signal, modifies the excitation sound source signal by reducing a non-periodic component in the excitation sound source signal according to a relative amount of the non-periodic component in the optimized excitation sound source signal so that the non-periodic component is reduced more when the relative amount of the periodic component is greater. The optimized excitation sound source signal modified as above is supplied to the above periodic excitation signal source unit 1 as the above feedback signal. When the input speech signal indicates a stronger pitch-periodic characteristic, the above optimized excitation sound source signal contains a larger amount of the pitch-periodic component. According to the present invention, in this case, the non-periodic component which is supplied to the periodic excitation signal source unit 1 to cause degradation in a regenerated speech signal, is further reduced by the above feedback signal modifying unit 7. Therefore, according to the present invention, the quality of the regenerated signal is improved compared with the conventional speech signal coding apparatus in which the above feedback signal modifying unit is not provided.

The second aspect of the present invention provides a speech signal decoding apparatus for inputting and decoding code information to regenerate a speech signal, corresponding to the above speech signal coding apparatus of FIG. 3. The construction constituted by the periodic excitation signal source unit 1, the non-periodic excitation signal source unit 2, the synthesizing unit 3, the short-term prediction filter 4, and the feedback signal modifying unit 7 constitutes a construction of the speech signal decoding apparatus according to the second aspect of the present invention, where the above first and second control signals are supplied to the periodic excitation signal source unit 1 and the non-periodic excitation signal source unit 2, respectively, as a portion of code information which is input to the speech signal decoding apparatus, and which the speech signal decoding apparatus should decode. The operation of the speech signal decoding apparatus is the same as the corresponding portion of the speech signal coding apparatus of FIG. 3 except that the above scanning of the first and second control signals is not carried out corresponding to the absence of the error evaluating unit 6, and the first and second control signals, which always give an optimized excitation sound source signal from the synthesizing unit 3, are supplied to the speech signal decoding apparatus as above.

Figure 4:
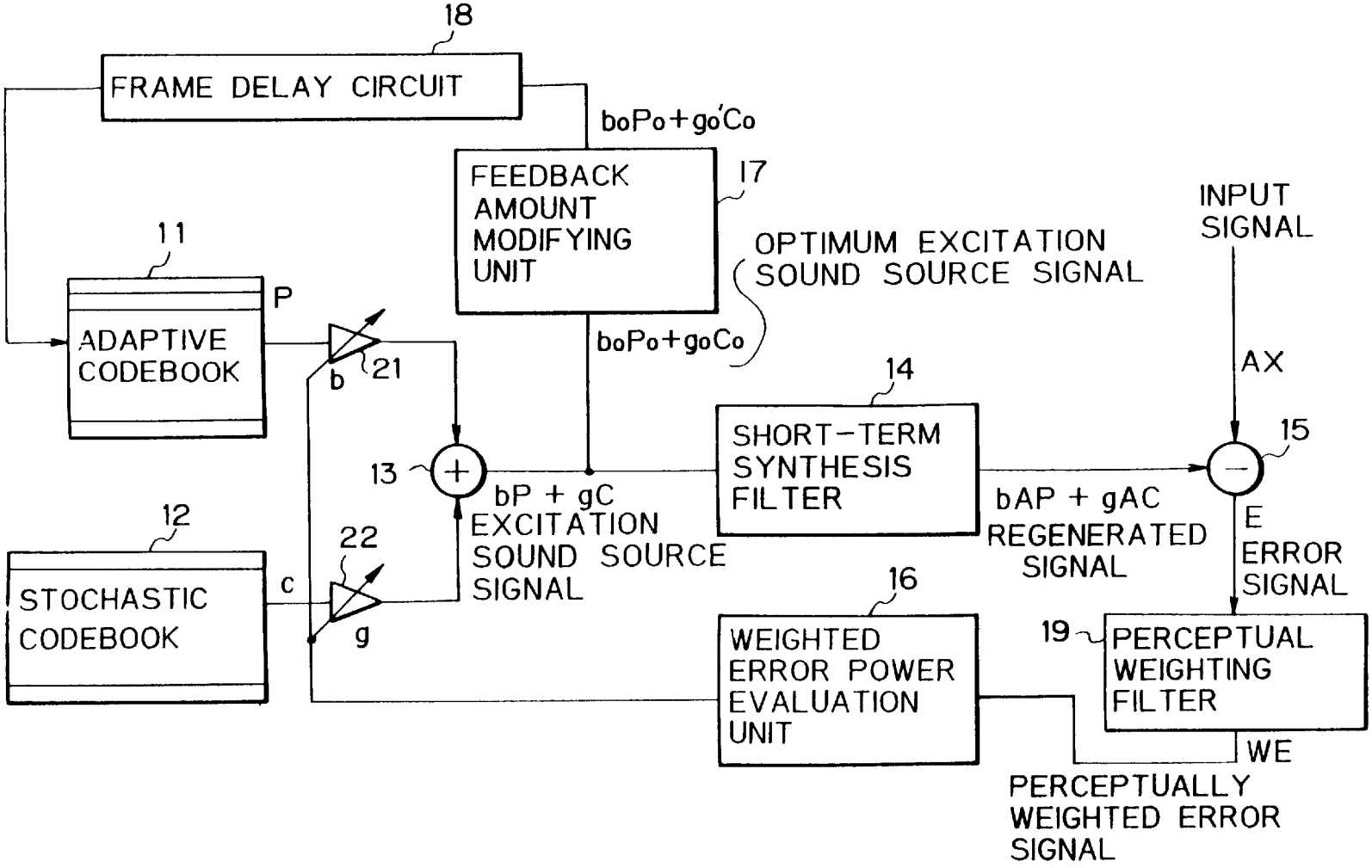
FIG. 4 is a diagram illustrating the construction of the speech coding apparatus in the first embodiment of the present invention.

First Embodiment of Speech Signal Decoding Apparatus (FIG. 4)

FIG. 4 is a diagram indicating the construction of the speech coding apparatus in the first embodiment of the present invention. In FIG. 4, reference numeral 17 denotes a feedback signal modifying unit, and all the other elements in FIG. 4 are the same as the corresponding elements in FIG. 1. The feedback signal modifying unit 17 corresponds to the feedback component modifying unit 7 in FIG. 3, inputs optimized parameters bo, Po, go, and Co which are determined by the error power evaluation unit 16 to give an optimized excitation sound source signal bo·Po+go·Co in a speech signal frame preceding the speech signal frame most recently input to the speech signal coding apparatus. Then, the feedback signal modifying unit 17 carries out calculations defined by the following pairs of equations (1) and (2), or (1) and (3) to obtain a modified feedback signal bo·Po+go'·Co which is to be supplied through the frame delay circuit 18 to the adaptive codebook 11.

$$g_o' = k_c \cdot g_o \tag{1}$$

$$k_c = \sqrt{\frac{|g_0 \cdot C_0|^2}{|b_0 \cdot p_0|^2 + |g_0 \cdot C_0|^2}} \tag{2}$$

$$k_c = \sqrt{\frac{|g_0 \cdot AC_0|^2}{|b_0 \cdot AP_0|^2 + |g_0 \cdot AC_0|^2}} \tag{3}$$

$$0 \leqq k_c \leqq 1$$

where A denotes an impulse response matrix of the short-term prediction synthesis filter 14.

As indicated in the equation (1), the optimized gain go is reduced by being multiplied by a coefficient kc, which is equal to or less than one, to suppress the non-periodic component go·Co in the feedback signal supplied to the adaptive codebook 11. According to the equation (2), the coefficient kc is determined based on the ratio of the power of the non-periodic component go·Co to the sum of the powers of the periodic component bo·Po and the non-periodic component go·Co in the optimized excitation sound source signal bo·Po+go·Co. As understood from the equations (1) and (2), the less the ratio of the power of the non-periodic component go·Co to the sum of the powers of the periodic component bo·Po and the non-periodic component go·Co in the excitation sound source signal bo·Po+go·Co is, the more the non-periodic component go·Co in the feedback signal supplied to the adaptive codebook 11 is suppressed. Namely, the stronger the pitch-periodic characteristic of the input speech signal is, the further the non-periodic component go·Co is suppressed. Thus, the quality of the regenerated speech signal for an input speech signal having a strong pitch-periodic characteristic is improved by the above construction.

In addition, when the ratio of the power of the periodic component bo·Po to the sum of the powers of the periodic component bo·Po and the non-periodic component go·Co is small, for example, the adaptive codebook 11 does not follow the pitch period of the input speech signal very well, or the input speech signal represents a voiceless sound, the above coefficient kc becomes large, and therefore the non-periodic component go·Co is not significantly suppressed, and is supplied to the adaptive codebook 11 so that the adaptive codebook 11 can follow the characteristic of the input speech signal.

The operation is similar to the above when the equations (1) and (3) are used in the calculation in the feedback signal modifying unit 17, except that the above coefficient kc for suppressing the non-periodic component in the feedback signal is determined based on the ratio of the power of the non-periodic component go·ACo to the sum of the powers of the periodic component bo·APo and the non-periodic component go·ACo in the regenerated signal bo·APo+go·ACo.

Figure 5:
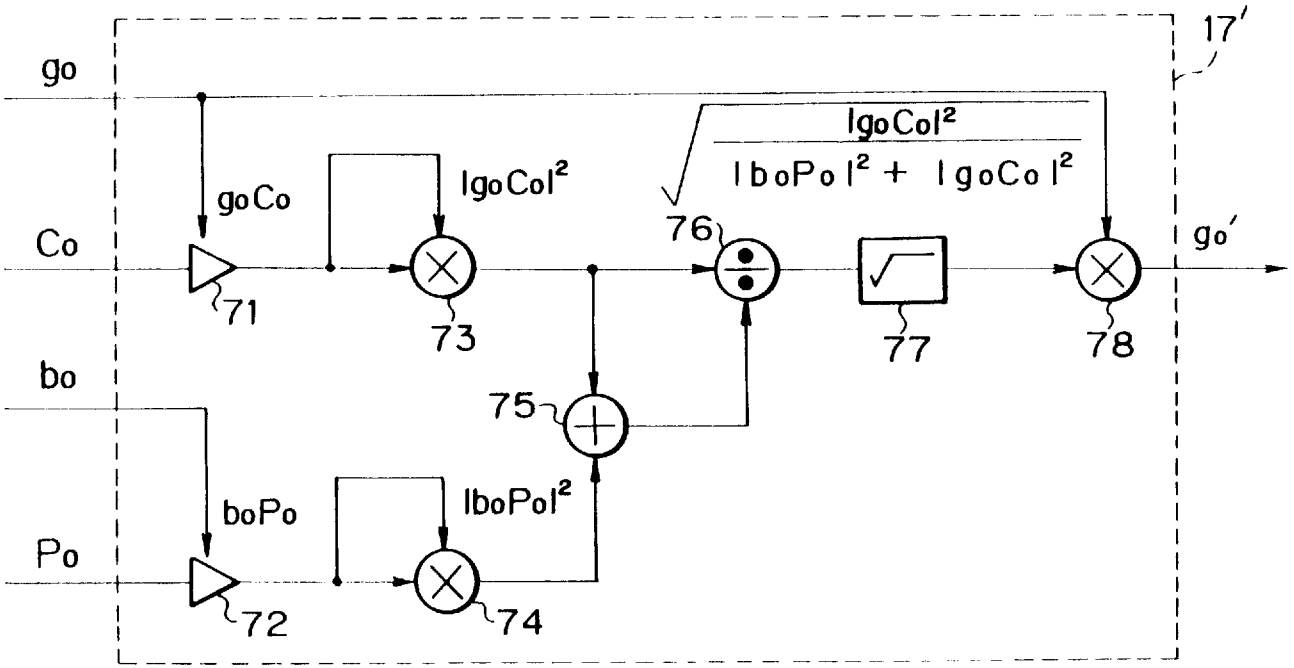
FIG. 5 indicates the construction of the feedback amount modifying unit 17 in the construction of FIG. 4.

Feedback Signal Modifying Unit 17 (FIG. 5)

FIG. 5 illustrates the construction of the feedback amount modifying unit 17 in the construction of FIG. 4. In FIG. 5, reference numerals 71 and 72 each denote an amplifier, 73, 74, and 78 each denote a multiplier, 75 denotes an adder, 76 denotes a divider, and 77 denotes a square root calculation circuit. The construction of FIG. 5 correspond to the equation (2). Since, in FIG. 5, outputs of the respective elements are indicated, the operation of FIG. 5 is self-explanatory.

Figure 6:
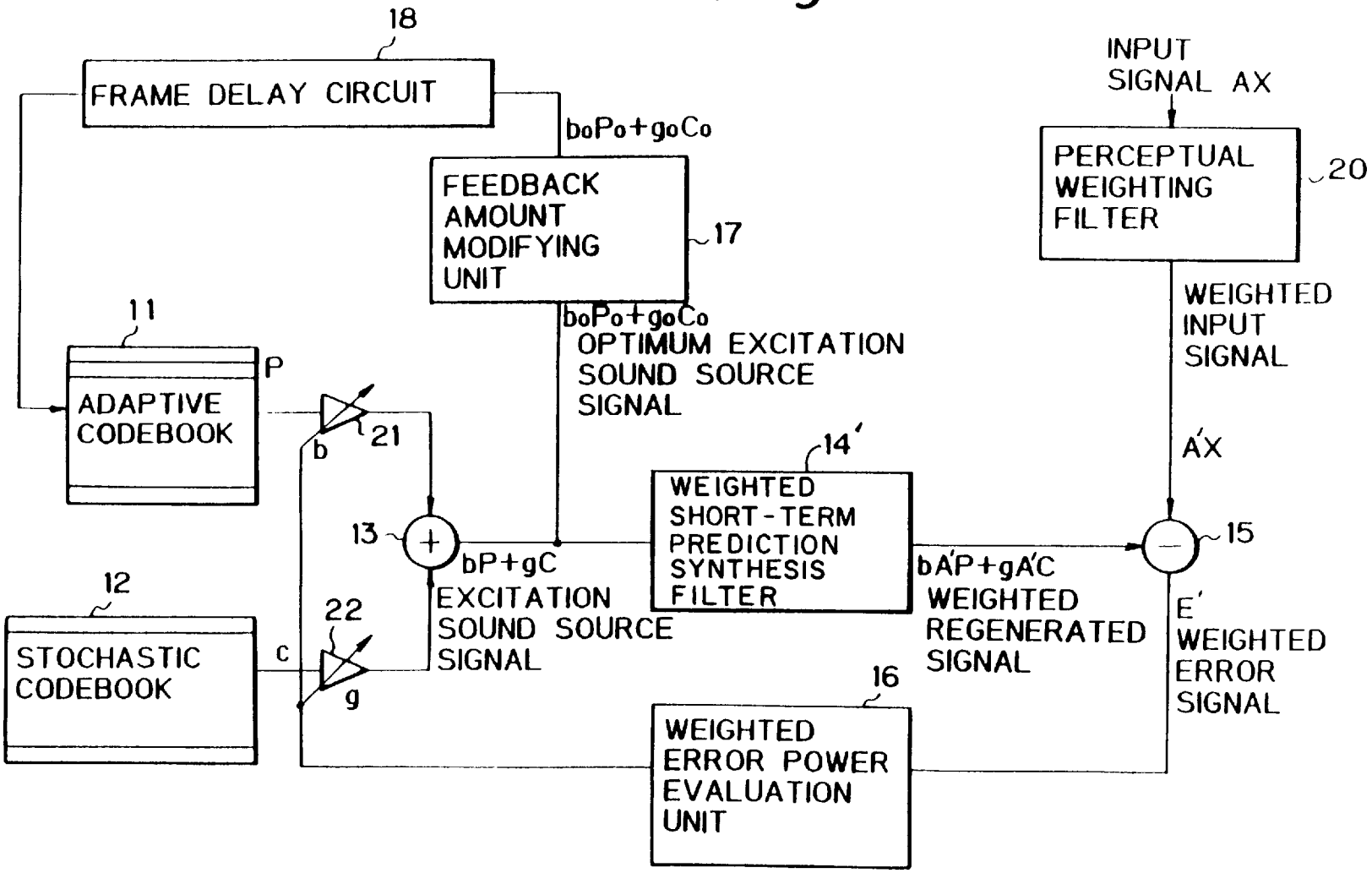
FIG. 6 is a diagram illustrating the construction of the speech coding apparatus in the second embodiment of the present invention.

Second Embodiment of Speech Signal Decoding Apparatus (FIG. 6)

FIG. 6 is a diagram indicating the construction of the speech coding apparatus in the second embodiment of the present invention. In FIG. 6, reference numeral 14' denotes a weighted short-term prediction synthesis filter, and 20 denotes a perceptual weighting filter, and all the other elements in FIG. 6 are the same as the corresponding elements in FIG. 4. The perceptual weighting filter 20 perceptual weights an input speech signal AX to generate a perceptually weighted input speech signal A'X which is to be supplied to the subtracter 15. The characteristic of the perceptual weighting filter 20 is the same as the perceptual weighting filter 19 in FIG. 1.

Corresponding to the perceptual weighting operation in the above perceptual weighting filter 20, the weighted short-term prediction synthesis filter 14' carries out the same perceptual weighting operation as above simultaneously with the short-term prediction to generate a perceptually weighted regenerated signal bA'P+gA'C which is equivalent to a signal generated by perceptual weighting the regenerated signal bAP+gAC in the first embodiment. The characteristic of the above short-term prediction synthesis filter 14' is expressed as $$A'(z) = W(z) \cdot A(z) = 1/\left(1 - \sum_{i=1}^{p} ai \cdot \lambda^i z^{-i}\right). \tag{3}$$

where A(z) and W(z) are respectively defined by the equations (1) and (2).

The subtracter 15 obtains a difference between the above perceptually weighted input speech signal A'X and the perceptually weighted regenerated signal bA'P+gA'C as a perceptually weighted error signal E' which is equivalent to the perceptually weighted error signal WE output from the perceptual weighting filter 19 in the first embodiment. The perceptually weighted error signal E' is supplied to the weighted error power evaluation unit 16. All the other operations in the second embodiment are the same as the first embodiment.

Speech Signal Decoding Apparatus (FIG. 4)

The speech signal decoding apparatuses corresponding to the above constructions of the first and second embodiments of the present invention are constituted by the adaptive codebook 11, the stochastic codebook 12, the amplifiers 21 and 22, the adder 13, the short-term prediction synthesis filter 14, the subtracter 15, the feedback amount modifying unit 17, and the frame delay circuit 18. The outputs of the speech signal decoding apparatuses corresponding to the above constructions of the first and second embodiments are obtained as the output of the short-term prediction synthesis filter 14.

We claim:

1. A speech signal coding apparatus inputting an input speech signal, and coding said input speech signal, comprising:

periodic excitation signal source means holding a set of a plurality of periodic excitation signals, for outputting one of said plurality of periodic excitation signals in response to a first control signal, where said set is adaptively modified according to a feedback signal supplied thereto;

non-periodic excitation signal source means holding a set of a plurality of non-periodic excitation signals, for outputting one of said plurality of non-periodic excitation signals in response to a second control signal;

synthesizing means for inputting and synthesizing said periodic excitation signal output from said periodic excitation signal source means and said non-periodic excitation signal output from said non-periodic excitation signal source means, to generate an excitation sound source signal;

short-term prediction filter means for inputting said excitation sound source signal, and generating a regenerated signal which simulates said input speech signal, based on excitation sound source signals recently input thereto, by short-term prediction;

error obtaining means for obtaining a difference between said input speech signal and said regenerated signal as an error signal;

error evaluating means for determining said first and second control signals so that a power of said error signal is minimized and thereby optimizing said excitation sound source signal; and feedback signal modifying means for inputting said optimized excitation sound source signal, modifying said optimized excitation sound source signal by reducing a non-periodic component in said optimized excitation sound source signal according to a relative amount of the non-periodic component in the optimized excitation sound source signal, so that the non-periodic component is reduced more when said relative amount of the periodic component is greater, and supplying said modified optimized excitation sound source signal to said periodic excitation signal source means as said feedback signal.

2. A speech signal coding apparatus according to claim 1, wherein said feedback signal modifying means suppresses said non-periodic component according to a ratio of a power of said non-periodic component to a sum of a power of said periodic component and a power of said non-periodic component in said excitation sound source signal.

3. A speech signal coding apparatus according to claim 1, wherein said feedback signal modifying means suppresses said non-periodic component according to a ratio of a power of a non-periodic component in said regenerated signal to a sum of a power of the non-periodic component and a power of a periodic component in said regenerated signal.

4. A speech signal coding apparatus according to claim 1, wherein said periodic excitation signal source means outputs one of said plurality of periodic excitation signals, in which a periodic signal component having a specific pitch period and corresponding to said first control signal is enhanced.

5. A speech signal coding apparatus according to claim 1, further comprising perceptual weighting filter means for perceptual weighting said error signal before the error signal is supplied to said error evaluating means, and said error evaluating means scans said first and second control signals while monitoring said perceptually weighted error signal, to adjust the first and second control signals so that a power of said perceptually weighted error signal is minimized and thereby optimizing said excitation sound source signal.

6. A speech signal coding apparatus according to claim 1, further comprising perceptual weighting filter means for perceptual weighting said input speech signal before the input speech signal is supplied to said subtracter, said short-term prediction filter means further perceptually weights said regenerated signal, said error obtaining means obtains a difference between the perceptually weighted input speech signal and the perceptually weighted regenerated signal as a perceptually weighted error signal, and said error evaluating means scans said first and second control signals while monitoring said perceptually weighted error signal, to adjust the first and second control signals so that a power of said perceptually weighted error signal is minimized and thereby optimizing said excitation sound source signal.

7. A speech signal decoding apparatus for inputting and decoding code information to regenerate a speech signal, comprising:

periodic excitation signal source means holding a set of a plurality of periodic excitation signals, for outputting one of said plurality of periodic excitation signals in response to a first control signal, where said set is adaptively modified according to a feedback signal thereto;

non-periodic excitation signal source means holding a set of a plurality of non-periodic excitation signals, for outputting one of said plurality of non-periodic excitation signals in response to a second control signal;

synthesizing means for inputting and synthesizing said one of the plurality of periodic excitation signals output from said periodic excitation signal source means and said one of the plurality of non-periodic excitation signals output from said non-periodic excitation signal source means, to generate an excitation sound source signal;

short-term prediction filter means for inputting said excitation sound source signal, and generating a regenerated signal which simulates said input speech signal, based on excitation sound source signals recently input thereto, by short-term prediction; and feedback signal modifying means for inputting said excitation sound source signal, modifying said excitation sound source signal by reducing a non-periodic component in said excitation sound source signal according to a relative amount of the non-periodic component in the excitation sound source signal, to reduce the non-periodic component when said relative amount of the periodic component is greater, and supplying said modified excitation sound source signal to said periodic excitation signal source means as said feedback signal.

8. A speech signal decoding apparatus according to claim 7, wherein said feedback signal modifying means suppresses said non-periodic component according to a ratio of a power of said non-periodic component to a sum of a power of said periodic component and a power of said non-periodic component in said excitation sound source signal.

9. A speech signal decoding apparatus according to claim 7, wherein said feedback signal modifying means suppresses said non-periodic component according to a ratio of a power of a non-periodic component in said regenerated signal to a sum of a power of a periodic component and a power of said non-periodic component in said generated signal.

10. A speech signal decoding apparatus according to claim 7, wherein said periodic excitation signal source means outputs one of said plurality of periodic excitation signals, in which a periodic signal component having a specific pitch period and corresponding to said first control signal is enhanced.

* * * * *

UNITED STATES PATENT AND TRADEMARK OFFICE

CERTIFICATE OF CORRECTION

PATENT NO.: 5,828,811
DATED : October 27, 1998
INVENTOR(S): Tomohiko TANIGUCHI et al.

It is certified that error appears in the above-identified patent and that said Letters Patent is hereby corrected as shown below:

Col. 4, line 46, change "goco" to --$g_0C_0$--.

Col. 6, lines 23-33, between equations (2) and (3), insert --$0 \leq k_c \leq 1$--.

Signed and Sealed this

Twentieth Day of April, 1999

*Attest:*

Q. TODD DICKINSON

*Attesting Officer*

*Acting Commissioner of Patents and Trademarks*